US012546306B2

(12) United States Patent
Bayyouk et al.

(10) Patent No.: US 12,546,306 B2
(45) Date of Patent: Feb. 10, 2026

(54) MECHANICALLY RESILIENT AND WEAR RESISTANT STEEL COMPOSITIONS AND HIGH-PRESSURE PUMPS AND PUMP COMPONENTS COMPRISED THEREOF

(71) Applicant: SPM Oil & Gas Inc., Fort Worth, TX (US)

(72) Inventors: Jacob Bayyouk, Richardson, TX (US); Alastair Scott Pearson, Glasgow (GB); Frank Hippenstiel, Siegen (DE); Michael Muller, Freudenberg (DE)

(73) Assignee: SPM Oil & Gas Inc., Fort Worth, TX (US)

( * ) Notice: Subject to any disclaimer, the term of this patent is extended or adjusted under 35 U.S.C. 154(b) by 161 days.

(21) Appl. No.: 18/256,589

(22) PCT Filed: Dec. 9, 2021

(86) PCT No.: PCT/US2021/062644

§ 371 (c)(1),
(2) Date: Jun. 8, 2023

(87) PCT Pub. No.: WO2022/125792

PCT Pub. Date: Jun. 16, 2022

(65) Prior Publication Data

US 2024/0044233 A1 Feb. 8, 2024

Related U.S. Application Data

(60) Provisional application No. 63/123,923, filed on Dec. 10, 2020.

(51) Int. Cl.
*F04B 53/00* (2006.01)
*C22C 33/02* (2006.01)
(Continued)

(52) U.S. Cl.
CPC ..... *F04B 53/007* (2013.01); *C22C 33/0285* (2013.01); *C22C 38/001* (2013.01);
(Continued)

(58) Field of Classification Search
CPC ..... F04B 53/007; F04B 53/16; F04B 53/10; F04B 53/1032; F04B 53/22; F04B 15/00;
(Continued)

(56) References Cited

U.S. PATENT DOCUMENTS 8,590,614 B2 * 11/2013 Surjaatmadja ..... F04B 15/02 417/552
9,435,333 B2 9/2016 Mccoy et al.
(Continued)

FOREIGN PATENT DOCUMENTS

AR 035035 A1 4/2004
AR 036499 A1 9/2004
(Continued)

OTHER PUBLICATIONS

Examination Report for Argentine patent appln. No. 20210103429, mailed Sep. 24, 2025 (10 pgs).

*Primary Examiner* — Peter J Bertheaud

(57) ABSTRACT

The present disclosure relates to a resistant steel composition comprising a nickel content from about 3% MB to about 4% MB; a manganese content from about 0.5% MB to about 1.5% MB; a chromium content from about 12% MB to about 13.4% MB; a molybdenum content from about 0.3% MB to about 0.7% MB; and a copper content of less than about 0.40% MB. In some embodiments, the present disclosure relates to a process for generating a resistant steel composition, the process comprising melting one or more resistant steel components together to form a melted steel; refining the melted steel to form a refined steel; and purifying the refined steel to form the resistant steel composition.

22 Claims, 4 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/18*** | (2006.01) |
| ***C22C 38/24*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |
| ***E21B 43/26*** | (2006.01) |
| ***F04B 1/0404*** | (2020.01) |
| ***F04B 15/00*** | (2006.01) |
| ***F04B 53/10*** | (2006.01) |
| ***F04B 53/16*** | (2006.01) |
| ***F04B 53/22*** | (2006.01) |

(52) U.S. Cl.
CPC ..... *C22C 38/002* (2013.01); *C22C 38/004* (2013.01); *C22C 38/02* (2013.01); *C22C 38/04* (2013.01); *C22C 38/06* (2013.01); *C22C 38/08* (2013.01); *C22C 38/12* (2013.01); *C22C 38/18* (2013.01); *C22C 38/24* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *E21B 43/2607* (2020.05); *F04B 1/0404* (2013.01); *F04B 15/00* (2013.01); *F04B 53/10* (2013.01); *F04B 53/1032* (2013.01); *F04B 53/16* (2013.01); *F04B 53/162* (2013.01); *F04B 53/166* (2013.01); *F04B 53/22* (2013.01)

(58) Field of Classification Search
CPC ..... F04B 53/166; F04B 53/162; C22C 38/44; C22C 38/18; C22C 38/42; C22C 38/06; C22C 38/46; C22C 38/04; C22C 38/48; C22C 38/50; C22C 38/24; C22C 33/0285; C22C 38/08; C22C 38/12; C22C 38/20; C22C 38/26; C22C 38/40; C22C 33/0257; C22C 33/0278; C22C 33/02; C22C 38/28; C22C 38/22; C22C 38/001; C22C 38/00
See application file for complete search history.

(56) References Cited

U.S. PATENT DOCUMENTS

| | | | | |
|---|---|---|---|---|
| 2003/0138342 | A1* | 7/2003 | Hirasawa ..... | C22C 38/002 148/609 |
| 2006/0029502 | A1 | 2/2006 | Kugelev et al. | |
| 2016/0033059 | A1 | 2/2016 | Fonte | |

FOREIGN PATENT DOCUMENTS

| | | | |
|---|---|---|---|
| AR | 038718 | A1 | 1/2005 |
| AR | 039268 | A1 | 2/2005 |
| CN | 101368224 | A | 2/2009 |
| CN | 103866193 | A | 6/2014 |
| CN | 104561447 | A | 4/2015 |
| CN | 106636955 | A | 5/2017 |
| CN | 109280858 | A | 1/2019 |
| CN | 110777229 | A | 2/2020 |
| GB | 563571 | A | 8/1944 |
| GB | 569785 | A | 6/1945 |
| GB | 1261757 | A | 1/1972 |
| JP | S5665914 | A | 6/1981 |
| JP | H01215917 | A | 8/1989 |
| JP | 2005-536631 | A | 12/2005 |
| JP | 5916968 | B2 | 5/2016 |
| MX | 2018006910 | A | 2/2019 |

* cited by examiner

MECHANICALLY RESILIENT AND WEAR RESISTANT STEEL COMPOSITIONS AND HIGH-PRESSURE PUMPS AND PUMP COMPONENTS COMPRISED THEREOF

CROSS-REFERENCE TO RELATED APPLICATIONS

This application is a 371 National Phase of PCT Application No. PCT/US2021/062644, filed Dec. 9, 2021, entitled "MECHANICALLY RESILIENT AND WEAR RESISTANT STEEL COMPOSITIONS AND HIGH-PRESSURE PUMPS AND PUMP COMPONENTS COMPRISED THEREOF," and claims the benefit of and priority to U.S. Provisional Patent Application No. 63/123,923, filed on Dec. 10, 2020, entitled "MECHANICALLY RESILIENT AND WEAR RESISTANT STEEL COMPOSITIONS AND HIGH-PRESSURE PUMPS AND PUMP COMPONENTS COMPRISED THEREOF," the disclosures of which are hereby incorporated by reference herein in their entirety.

FIELD OF THE DISCLOSURE

The present disclosure relates, in some embodiments, to mechanically resilient and wear resistant steel compositions (i.e., a resistant steel composition). In some embodiments, the disclosure relates to high-pressure pumps and pump components comprised of a resistant steel composition (e.g., a fluid end assembly of a hydraulic fracturing pump).

BACKGROUND

Hydraulic fracturing is an oil well stimulation technique in which bedrock is fractured (i.e., fracked) by the application of a pressurized fracking fluid. The effectiveness of fracking fluid is due not only to pressurization, but also to its composition of one or more proppants (e.g., sand) and chemical additives (e.g., dilute acids, biocides, breakers, pH adjusting agents). The application of pressurized fracking fluid to existing bedrock fissures creates new fractures in the bedrock, as well as, increasing the size, extent, and connectivity of existing fractures. This permits more oil and gas to flow out of the rock formations and into the wellbore, from where they can be extracted.

Hydraulic fracturing pumps generally consist of a power end assembly and a fluid end assembly, with the power end assembly pressurizing a fracking fluid to generate a pressurized fluid and the fluid end assembly directing the pressurized fluid into the wellbore through a series of conduits. Hydraulic fracking pump components (e.g., a fluid end assembly) that are exposed to fracking fluid are prone to fluid leakage, failure, and other sustainability issues due to wear, corrosion, and degradation resulting from their exposure to components of the fracking fluid having corrosive or abrasive properties (e.g., proppant, chemical additives). Additionally, hydraulic fracking components may be prone to mechanical malformation due to excess mechanical and chemical pressure along with a breakdown that results from the above-mentioned wear. As a result hydraulic fracking pump components require frequent replacement at a substantial cost.

The composition of hydraulic pump components plays a large role in both the frequency of replacement and cost. While pump components composed of stainless steel have a life span of around 2000 working hours, the exorbitant cost of stainless steel often makes their use cost prohibitive. By contrast, pump components composed of carbon steel alloy offer an inexpensive price point, but have a life span of only about 10-15% compared to their stainless steel counterparts (e.g., 200-300 working hours). Accordingly, there is a need for hydraulic pump components that are mechanically and chemically resistant to abrasion, corrosion, and malformation—providing an advanced working life span—and available at an affordable price point.

BRIEF DESCRIPTION OF THE DRAWINGS

Exemplary embodiments of the present disclosure are described herein with reference to the drawings, wherein like parts are designated by like reference numbers, and wherein.

SUMMARY

Figure 1:
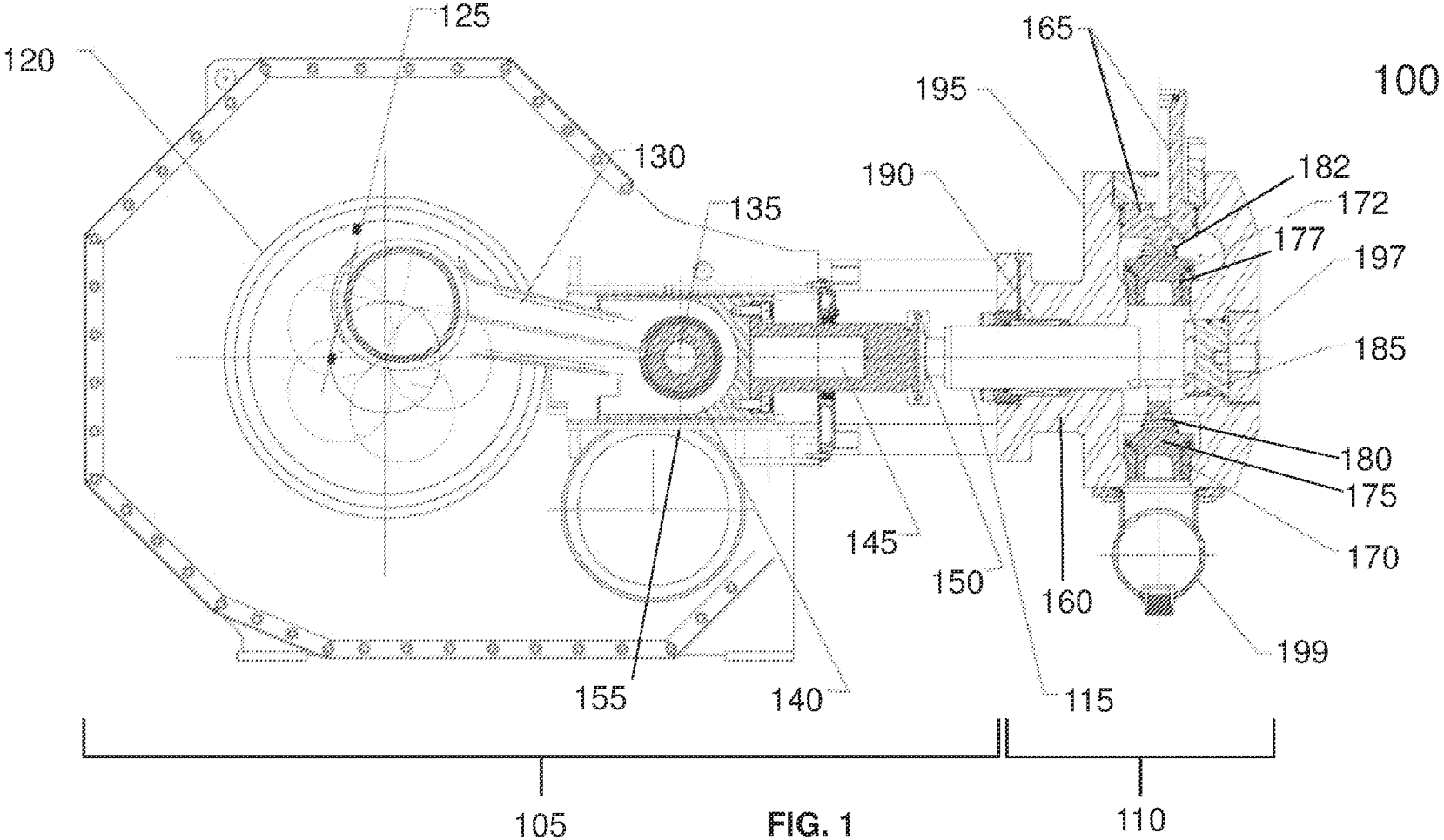
FIG. 1 illustrates a cross-sectional perspective of a general hydraulic fracturing pump.

The present disclosure relates to a resistant steel composition including a nickel content from about 3% MB to about 4% MB; a manganese content from about % MB to about 1.5% MB; a chromium content from about 12% MB to about 13.4% MB; a molybdenum content from about 0.3% MB to about 0.7% MB; and a copper content of less than about 0.40% MB.

In some embodiments, the present disclosure relates to a hydraulic fracturing pump comprising a fluid end assembly, the fluid end assembly including a cylinder body configured to receive a respective plunger from a power end assembly; a suction bore configured to house a valve body, a valve seat, and a spring; and a spring retainer. At least one of the cylinder body, the suction bore, and the spring retainer contains a steel composition containing a nickel content from about 3% MB to about 4% MB; a manganese content from about 0.5% MB to about 1.5% MB; a chromium content from about 12% MB to about 13.4% MB; a molybdenum content from about 0.3% MB to about 0.7% MB; and a copper content of less than about 0.40% MB.

The present disclosure relates to a process for generating a resistant steel composition, the process including melting one or more resistant steel components together to form a melted steel; refining the melted steel to form a refined steel; and purifying the refined steel to form the resistant steel composition. A resistant steel composition may include at least one of a nickel content from about 3% MB to about 4% MB; a manganese content from about 0.5% MB to about 1.5% MB; a chromium content from about 12% MB to about 13.4% MB; a molybdenum content from about 0.3% MB to about 0.7% MB; and a copper content of less than about 0.40% MB.

In some embodiments, the present disclosure relates to resistant steel compositions. A resistant steel composition may include a carbon content of less than about 0.05% MB and a nitrogen content of less than about 0.10% MB. A resistant steel composition may include an aluminum content of less than about 0.025% MB. A resistant steel composition may include at least one of a combined carbon and nitrogen content ranging from about 0.03% MB to about 0.1% MB, a combined titanium, niobium, and vanadium content ranging from about 0.01% MB to about 15% MB, and a combined molybdenum and tungsten content ranging from about 0.32% MB to about 0.70% MB. A resistant steel may include at least one of a J-Factor value of less than about 300, a minimum yield strength ranging from 130 Ksi to 150 Ksi, a YTS ranging from 140 Ksi to 160 Ksi, and a longitudinal minimum Charpy @−22° F. ranging from 70 ft./lbs. to 90 ft./lbs. A resistant steel may include at least one of a transverse minimum Charpy @−22° F. ranging from 60 ft./lbs. to 80 ft./lbs., an elongation value of 16/14 (L/T), an Ra value of 55/50 (L/T), and a Brinell Hardness Number ranging from 315 to 375. A resistant steel composition may include at least one of a material endurance limit that is 25% greater than comparable stainless steel and carbon steel counterparts, a fracture toughness that is 400% greater than comparable stainless steel and carbon steel counterparts, a lifespan that is at least 10% longer than comparable stainless steel and carbon steel counterparts, an exhibition of from at least 5% to at least 50% less pitting than comparable stainless steel and carbon steel counterparts, and a manufacturing cost that is from at least 5% less to at least 60% less than comparable stainless steel and carbon steel counterparts.

A process for generating a resistant steel composition may include removing a slag during the refining of the melted steel. A process for generating a resistant steel composition may include decarburizing the refined steel with an argon oxygen decarburization process during the purifying of the refined steel. A process for generating a resistant steel composition may include at least one of removing dissolved gases and undesired elements during the purifying of the refined steel and casting the resistant steel composition into an ingot.

DETAILED DESCRIPTION

The present disclosure relates to steel compositions having increased mechanical resilience and resistance to wear or corrosion when compared to a carbon alloy steel counterpart (i.e., a resistant steel composition). Moreover, the present disclosure relates to a resistant steel composition having a lower manufacturing cost than a stainless steel counterpart having similar wear or corrosion properties. In some embodiments, the present disclosure relates to a resistant steel composition having increased resistance to mechanical malformation as well as wear or corrosion when compared to a carbon steel alloy counterpart and having a manufacturing cost sufficiently lower than a stainless steel counterpart such that the combination of properties is desirable.

Resistant Steel Compositions

As illustrated in Table 1, a carbon steel alloy is defined by its main alloying ingredient of carbon and its properties are predominantly dependent upon the percentage of carbon present. As carbon percentages rise, a carbon alloy steel has increased hardness and reduced ductility. Carbon alloy steel is ordinarily grouped into three categories: low carbon steel including between 0.05% and 0.3% MB carbon, medium carbon steel including between 0.3% and 0.8% MB carbon, and high carbon steel including between 0.8% MB and 2% MB carbon. Although the primary element of interest is carbon, a ferritic-pearlitic carbon alloy steel may also include by mass, a manganese content from 0.75% MB to 1.75% MB, a nickel content of 0.25% MB, a copper content of less than 0.6% MB, a sulfur content of less than 0.035% MB, a silicon content from 0.1% MB to 2.2% MB, and an aluminum content from 0.02% MB to 0.10% MB, a phosphorous content of less than 0.04% MB, a molybdenum content of less than 0.08% MB, a niobium content of less than 0.10% MB, a vandium content of less than 0.1% MB, a titanium content of less than 0.1% MB, a nitrogen content of less than 0.05% MB, and any combination thereof. A carbon alloy steel ordinarily includes only trace amounts of chromium. A carbon alloy steel is susceptible to mechanical malformation in the presence of mechanical stresses and high-pressures caused by fracking fluids. Carbon alloy steel is susceptible to wear and corrosion, particularly when exposed to corrosive materials such as a fracking fluid. A carbon alloy steel component (e.g., a fluid end assembly composed of carbon alloy steel) may have a life span of up to 100 hours, or up to 150 hours, or up to 200 hours, or up to 250 hours, or up to 300 hours.

By contrast, a stainless steel (e.g., ferritic or soft-martensitic stainless steel) includes a low carbon content of 0.03% to 0.15% MB and high levels of chromium, ordinarily ranging from 11% to 30% MB. The high chromium content of stainless steel contributes to its high manufacturing cost. A stainless steel may have varying levels of other elements including copper, manganese, nickel, molybdenum, titanium, niobium, nitrogen, sulfur, phosphorus, and selenium, depending upon the specific properties desired. Typically, only trace levels of aluminum are present in stainless steel. This is shown in Table 1 wherein stainless steel has, by mass: a carbon content from 0.03% MB to 0.15% MB, a silicon content from 0.75% MB to 1% MB, a sulfur content from 0.01% MB to 0.03% MB, a nickel content from 10.5% MB to 28% MB, a manganese content from 2.0% MB to 7.5% MB, a phosphorous content of less than 0.06% MB, a nitrogen content of less than 0.2% MB, and a chromium content from 11% MB to 30% MB. No minimum content of copper, molybdenum, niobium, vanadium, titanium, and aluminum is specified or required for the stainless steel. Table 1 provides an example of a Wear and Corrosion resistant steel composition, but should not be construed as limiting. Table 2, which also should not be construed as limiting, provides additional examples of resistant steel composition element ranges along with added benefits of having elements within these ranges. These include having a C+N content ranging from about 0.03% MB to about 0.1% MB providing delta-ferrite protection, a Ti+Nb+V content ranging from about 0.01% MB to about 0.15% MB to provide carbide protection, and a Mo+W content ranging from about 0.32% MB to about 0.70% MB to provide segregation protection. In some embodiments, a resistant steel composition may be a predominately-tempered martensite. A resistant steel composition may be free of delta ferrite as measured in accordance with AMS 2315. Segregation protection includes protection against a crystal segregation that may form in the presence of a higher molybdenum and tungsten content, which may result in an uneven (e.g., greater variation, inconsistent, poor) mechanical properties. In some embodiments, a disclosed resistant steel composition includes a Cr/(C+N) value ranging from about 130 to about 350 to provide corrosion resistance and segregation protection.

A disclosed resistant steel composition includes a J-Factor ($(Mn+Si)\times(P+Sn)\times10^4$) value of less than about 300 to provide for cleanliness and embrittlement protection. For example, a resistant steel composition may have a J-Factor value from about 1 to about 50, or about 50 to about 100, or about 100 to about 150, or about 150 to about 200, or about 200 to about 250, or about 250 to about 300, where about includes plus or minus 25.

Stainless steel is highly resistant to mechanical malformation, corrosion, and wear, even upon exposure to high-pressure corrosive materials such as a fracking fluid. A stainless steel component (e.g., a fluid end assembly composed of carbon alloy steel) may have a life span of at least 1,800 hours, or at least 1,900 hours, or at least 2,000 hours, or at least 2,100 hours, or at least 2,200 hours.

Table 3 contains resistant steel compositions according to disclosed embodiments. Disclosed steel compositions are not limited to those listed in Tables 1-3, but instead include compositions having elements at various concentrations. According to some embodiments, a resistant steel compositions may comprise a carbon content of less than about 0.05% MB. For example, a resistant steel composition may have a carbon content from about 0.001% MB to about 0.05% MB, with "about" as used in this sentence being plus or minus 0.01% MB. For example, a resistant steel may include a carbon content of about 0.001% MB, or about 0.002% MB, or about 0.003% MB, or about 0.004% MB, or about 0.005% MB, or about % MB, or about 0.007% MB, or about 0.008% MB, or about 0.009% MB, or about 0.01% MB, or about 0.02% MB, or about 0.03% MB, or about 0.04% MB, or about 0.05% MB, where about includes plus or minus 0.01% MB. A resistant steel composition may include a nickel content from about 3% MB to about 4% MB, where about includes plus or minus 0.1% MB. For example, a resistant steel composition may include a nickel content of about 3% MB, or about 3.1% MB, or about 3.2% MB, or about 3.3% MB, or about 3.4% MB, or about 3.5% MB, or about 3.6% MB, or about 3.7% MB, or about 3.8% MB, or about 3.9% MB, or about 4.0% MB, where about includes plus or minus 0.1% MB. In some embodiments, a resistant steel may include a nickel content ranging from about 3.5% MB to about 3.85% MB. A resistant steel composition may include a manganese content from about 0.5% MB to about 1.5% MB, with "about," as used in this sentence being plus or minus 0.1% MB. For example, a resistant steel composition may include a manganese content of about 0.5% MB, or about 0.6% MB, or about % MB, or about 0.8% MB, or about 0.9% MB, or about 0.10% MB, or about % MB, or about 0.12% MB, or about 0.13% MB, or about 0.14% MB, or about % MB, where about includes plus or minus 0.01% MB. In some embodiments, a resistant steel composition may include a chromium content from about 12% MB to about 13.4% MB, with "about" as used in this sentence being plus or minus 1% MB. A resistant steel composition, may include a copper content of at most about 0.4% MB, with "about" as used in this sentence being plus or minus "0.05% MB." For example, in some embodiments, a resistant steel composition may include a copper content in a range of about 0.01% MB to about 0.05% MB, or 0.01% MB to 0.4% MB, or 0.05% MB to 0.25%, or about 0.01% MB to 0.25% MB, or about 0.25% MB to about 0.4% MB, where about includes plur os minus 0.05% MB. In some embodiments, a resistant steel composition may include a sulfur content of less than about 0.005% MB, with "about" as used in this sentence being plus or minus "0.001% MB." For example, a resistant steel composition may include a sulfur content of about 0% MB, or about 0.005% MB, or about 0.004% MB, or about 0.003% MB, or about 0.002% MB, or about 0.001% MB, where about includes plus or minus % MB. A resistant steel composition may include a silicon content of less than about 0.6% MB, with "about" as used in this sentence being plus or minus 0.1% MB. For example, a resistant steel composition may include a silicon content of about 0% MB, or about 0.25% MB, or about 0.5% MB, or about 0.55% MB, or about 0.3% MB, where about includes plus or minus 0.1% MB. According to some embodiments, a resistant steel composition may include an aluminum content of less than about 0.025% MB, with "about" as used in this sentence being plus or minus 0.005% MB. For example, a resistant steel composition may include an aluminum content of about 0% MB, or about 0.005% MB, or about 0.001% MB, or about 0.002% MB, or about % MB, or about 0.004% MB, or about 0.005% MB, or about 0.006% MB, or about 0.007% MB, or about 0.008% MB, or about 0.009% MB, or about 0.01% MB, where about includes plus or minus 0.001% MB. A resistant steel composition may include a phosphorous content of less than about 0.025% MB, with "about" as used in this sentence being plus or minus 0.01% MB. For example, a resistant steel composition may include a phosphorous content of about 0% MB, or about 0.01% MB, or about 0.02% MB, or about 0.015% MB, or about 0.025% MB, where about includes plus or minus 0.01% MB. A resistant steel composition may include a molybdenum content of from about 0.3% MB to about 0.7% MB, with "about" as used in this sentence being plus or minus 0.1% MB. For example, a resistant steel composition may include a molybdenum content of about 0.5% MB, or about 0.1% MB, or about 0.3% MB, or about 0.4% MB, where about includes plus or minus 0.1% MB.

A resistant steel composition may include a combined niobium and tantalum content of less than about 0.05% MB, with "about" as used in this sentence being plus or minus 0.01% MB. For example, a resistant steel composition may include a combined niobium and tantalum content of 0.01% MB, or 0.03% MB, or 0.04% MB, or 0.05% MB, or 0.015% MB. A resistant steel composition may include a nitrogen content from about 0.02% MB to about 0.10% MB, with "about" as used in this sentence being plus or minus 0.01% MB. For example, a resistant steel composition may include a nitrogen content of about 0.02% MB, or about 0.03% MB, or about 0.04% MB, or about 0.05% MB, or about 0.06% MB, or about 0.07% MB, or about 0.08% MB, or about 0.09% MB, or about 0.10% MB, where about includes plus or minus 0.01% MB.

| Composition | C | Mn | Cr | Ni | Cu | S | Si | Al | P | Mo | Nb + Ta | N | Ti |
|---|---|---|---|---|---|---|---|---|---|---|---|---|---|
| Resistant Steel Composition | <0.05 | 0.5-1.5 | 12-13.4 | 3-4 | <0.4 | <0.005 | <0.6 | <0.025 | <0.025 | 0.3-0.7 | <0.05 | <0.10 | |
| Carbon Steel | 0.05-0.3 (low) 0.3-0.8 (med.) | 0.75-1.75 | trace | 0.25 | <0.6 | <0.035 | 0.1-2.2 | 0.02-0.1 | <0.04 | <0.08 | <0.10 | <0.05 | <0.1 |

-continued

| Composition | C | Mn | Cr | Ni | Cu | S | Si | Al | P | Mo | Nb + Ta | N | Ti |
|---|---|---|---|---|---|---|---|---|---|---|---|---|---|
| Stainless Steel | 0.8-2 (high) 0.03-0.15 | 2-7.5 | 11-30 | 10.5-28 | — | 0.01-0.03 | 0.75-1 | — | <.06 | — | — | <0.2 | |

*All values are provided as mass basis (MB).

TABLE 2

Additional Resistant Steel Parameters

| Composition | C + N | Ti + Nb + V | Mo + W | Cr/(C + N) | J-Factor = (Mn + Si) × (P + Sn) × $10^4$ |
|---|---|---|---|---|---|
| Resistant Steel Composition | 0.03-0.1 | 0.01-0.15 | 0.32-0.7 | 0.13-0.35 | <300 |
| Benefit | Delta-ferrite protection | Carbide protection | Segregation protection | Corrosion resistance, segregation protection | Cleanliness, embrittlement protection |

TABLE 3

Exemplary resistant steel compositions

| Composition | C | Mn | Cr | Ni | Cu | S | Si | Al | P | Mo | Nb | N |
|---|---|---|---|---|---|---|---|---|---|---|---|---|
| 1 | 0.05 | 0.7 | 13.3 | 3.1 | 0.25 | 0.001 | 0.5 | 0.01 | 0.001 | 0.5 | 0.001 | 0.04 |
| 2 | 0.035 | 1.2 | 13.2 | 3.3 | 0.001 | 0.002 | 0.3 | 0.025 | 0.015 | 0.6 | 0.025 | 0.05 |
| 3 | 0.04 | 1.0 | 13.0 | 3.8 | 0.01 | 0.004 | 0.6 | 0.02 | 0.025 | 0.7 | 0.05 | 0.03 |
| 4 | 0.045 | 1.5 | 12.5 | 4 | 0.1 | 0.005 | 0.1 | 0.015 | 0.01 | 0.4 | 0.03 | 0.02 |
| 5 | 0.01 | 0.5 | 12.7 | 3 | 0.05 | 0.001 | 0.05 | 0.001 | 0.02 | 0.3 | 0.04 | 0.01 |
| 6 | 0.05 | 0.8 | 12.8 | 3.95 | 0.1 | 0.001 | 0.3 | 0.01 | 0.02 | 0.5 | 0.01 | 0.03 |

*All values are provided as mass basis (MB).

A resistant steel composition may have enhanced mechanical malformation, corrosion, and wear resistance properties in comparison to a non-resistant steel. A resistant steel composition may have enhanced minimum Charpy values at a given temperature, enhanced elongation values, enhanced hardness, Ra value (roughness measurement), ultimate tensile strength, and yield, in comparison to non-resistant steels. Table 4 shows a minimum specification and toughness capabilities of a resistant steel composition. A resistant steel composition has surprisingly significant and superior performance in material toughness properties when compared to comparative stainless steel materials with similar tensile properties. A resistant steel composition has a Charpy Average @−22° F. (minus 22° F.) in the transverse direction of no less than 80 ft-lbs while also consistently being greater than 100 ft-lbs. A resistant steel may be less prone to crack initiation or propagation in comparison to stainless steel and carbon steel counterparts. A resistant steel may have a material endurance limit that is 25% greater and a fracture toughness that is 400% greater than comparable stainless steel and carbon steel counterparts.

A resistant steel composition may have enhanced wear resistance, corrosion resistance, or a combination thereof when compared to a carbon alloy steel. In some embodiments, a resistant steel composition may have an extended life span when compared to a carbon steel alloy. For example, a resistant steel composition when compared to a carbon steel alloy exposed to the same conditions may have an average lifespan that is at least 10% longer, at least 25% longer, or at least 50% longer, or at least 100% longer, or at least 125% longer, or at least 150% longer, or at least 200% longer, or at least 250% longer, or at least 300% longer, or at least 350% longer, or at least 400% longer, or at least 450% longer, or at least 500% longer than that of its carbon steel alloy counterpart. In some embodiments, a resistant steel exhibits an average lifespan that ranges from at least 10% longer to at least 500% longer than that of a carbon steel alloy counterpart when exposed to a fracking fluid or components of the fracking fluid.

According to some embodiments, a hydraulic fracturing pump having one or more components made of a disclosed resistant steel composition may have an average lifespan that is from at least 10% longer to at least 500% longer, in comparison to a counterpart hydraulic fracturing pump having one or more components made of a carbon steel alloy.

TABLE 4

Minimum specification and toughness capabilities of a resistant steel composition

| Example | Yield (Ksi) | UTS (Ksi) | Min. Charpy @ −22° F. Longitudinal (ft./lbs.) Ind. | Longitudinal Avg. | Transverse (ft./lbs.) Ind. | Transverse Avg. | Elong L/T | Ra L/T | Hardness (BHN) |
|---|---|---|---|---|---|---|---|---|---|
| Minimum Specification | 130-150 | 140-160 | 70 | 90 | 60 | 80 | 16/14 | 55/50 | 315-375 |
| Toughness Capabilities | N/A | N/A | >100 | >120 | >75 | >100 | N/A | N/A | N/A |

A resistant steel composition may exhibit less pitting (indicative of corrosion) compared to a carbon steel alloy exposed to the same conditions. For example, a resistant steel composition may exhibit at least 5%, or at least 10%, or at least 15%, or at least 20%, or at least 25%, or at least 30%, or at least 35%, or at least 40%, or at least 45%, or at least 50% less pitting compared to its carbon alloy steel counterpart. According to some embodiments, a hydraulic fracturing pump having one or more components made of a disclosed resistant steel composition may exhibit from at least 5% to at least 50% less pitting, in comparison to a counterpart hydraulic fracturing pump having one or more components made of a carbon steel alloy.

In some embodiments, a corrosive may include a fracking fluid, an acid, a base, and a combination thereof. A corrosive may include an acid including at least one of hydrochloric acid, a sulfuric acid, a nitric acid, a chromic acid, an acetic acid, and a hydrofluoric acid. In some embodiments, a corrosive includes a base including an ammonium hydroxide, a potassium hydroxide, a sodium hydroxide, and combinations thereof. According to some embodiments, pitting may be caused at least in part by a response to exposure to a particle (e.g., sand) having a size ranging from about 1 micron to about 3,000 microns, or larger. A particle may have a size of about 1 micron, or about 10 microns, or about 20 microns, or about 30 microns, or about 40 microns, or about 50 microns, or about 60 microns, or about 70 microns, or about 80 microns, or about 90 microns, or about 100 microns, where about includes plus or minus 5 microns. A particle may have a size of about 100 microns, or about 300 microns, or about 600 microns, or about 900 microns, or about 1,200 microns, or about 1,500 microns, or about 1,800 microns, or about 2,100 microns, or about 2,400 micron, or about 2,700 microns, or about 3,000 microns, where about includes plus or minus 150 microns.

A resistant steel composition may exhibit an average lifespan, less pitting, or a combination thereof compared to a carbon alloy steel counterpart.

A resistant steel composition may have a manufacturing cost that is less than a stainless steel counterpart. For example, a resistant steel composition may have a manufacturing cost that is at least 5% less, or at least 10% less, or at least 15% less, or at least 20% less, or at least 30% less, or at least 40% less, or at least 50% less, or at least 60% less than a stainless steel composition having comparable life span and/or resistance characteristics. According to some embodiments, a hydraulic fracturing pump having one or more components made of a disclosed resistant steel composition may have a manufacturing cost that is from at least 5% less to at least 60% less, in comparison to a counterpart hydraulic fracturing pump having one or more components made of a stainless steel composition.

In some embodiments, a resistant steel composition may have a manufacturing cost that is at least at least 5% less, or at least 10% less, or at least 15% less, or at least 20% less, or at least 30% less, or at least 40% less, or at least 50% less, or at least 60% less than a stainless steel composition when factored as a cost per average working hour.

According to some embodiments, a hydraulic fracturing pump having one or more components made of a disclosed resistant steel composition may have a manufacturing cost that is from at least 5% less to at least 60% less, in comparison to a counterpart hydraulic fracturing pump having one or more components made of a stainless steel composition, when factored as a cost per average working hour. For example, if a stainless steel composition has a lifespan of 2000 working hours at a cost of $3 USD per pound. The cost of the stainless steel composition is $0.0015 per pound working hour.

In some embodiments, a resistant steel composition may have a decreased eutectoid reaction when compared to its carbon steel alloy counterpart.

Processes for Generating Resistant Steel Compositions

According to some embodiments, the present disclosure relates to a process for generating a resistant steel compositions. A process includes a step of generating a steel composition including one or more of a nickel content from about 3% MB to about 4% MB; a manganese content from about 0.5% MB to about 1.5% MB; a chromium content from about 12% MB to about 13.4% MB; a molybdenum content from about 0.3% MB to about 0.7% MB; and a copper content of less than about 0.40% MB.

According to some embodiments, a resistant steel composition may be generated by melting one or more resistant steel components (e.g., nickel, manganese, chromium, carbon) in an electric arc furnace to form a melted steel. A resistant steel component may be derived from, but is not limited to an alloy and a scrap metal. A melted steel may be refined to remove slag to form a refined steel. A process includes purifying the refined steel to remove dissolved gases and undesired elements to form a resistant steel composition. A purifying step may include use of an Argon Oxygen Decarburization (AOD) process. A resistant steel as formed through these steps may be cast into an ingot for further use. In some embodiments, a resistant steel may be forged into any desired geometry and may be subject to any desired heat treatment.

Processes for Generating Fluid End Components

According to some embodiments, the present disclosure relates to a process for generating a fluid end component containing a resistant steel composition. A process includes heating an ingot to a forging temperature ranging from about 850° C. to about 1,300° C. and then forging the ingot into any specific geometry to form a forged metal. A forged metal may have a shape of any fluid end component (e.g., cylinder body, suction bore). A forged metal may be treated to a qualified heat treatment that may include one or more of austenitizing, one or more tempering, stress relieving, and annealing to form a qualified metal. In some embodiments, temperatures for the above steps may be selected as to provide for one or more of a fine grain structure and desired mechanical properties.

Resistant Steel Compositions and Fluid End Components Comprises Therefrom

The present disclosure further relates to hydraulic fracturing pumps and pump components composed of a resistant steel composition. FIG. 1 illustrates the basic components of a hydraulic fracturing pump 100. In general, hydraulic fracturing pumps 100 are made up of a power end assembly 105 and a fluid end assembly 110. The power end assembly 105 drives reciprocating motion of plungers 115 and the fluid end assembly 110 directs the flow of fracking fluid from the pump to conduits leading to the wellbore. As shown in FIG. 1, the basic power end assembly 105 components include a frame 120, a crank shaft 125, a connecting rod 130, a wrist pin 135, a crosshead 140, a crosshead case 155, a pony rod 145, a pony rod clamp 150, and a plunger 115.

As disclosed in FIG. 1, the crankshaft 125, while contained within a frame 120, is rotated by a power source such as an engine. One or more connecting rods 130 have ends that are rotatably mounted to the crankshaft 125, wherein the opposite end of each connecting rod 130 is pivotally connected to a crosshead 140. The rotary motion of the crankshaft 125 is converted to linear motion by the crosshead 140. Each crosshead 140 is reciprocally carried within a stationary crosshead case 155. The pony rod 145 is attached to an end of the crosshead 140 that is opposite to the crank shaft 125. The plunger 115 is mounted to an end of the pony rod 145 by a pony rod clamp 150. The pony rod 145 moves, or strokes, the plunger 115 within a cylinder of a fluid end assembly. The wrist pin 135 (sometimes referenced as a gudgeon pin in the art) secures the plunger 115 to the connecting rod 130 and provides a bearing for the connecting rod 130 to pivot upon as the plunger 115 moves.

As shown in FIG. 1, the basic fluid end assembly 110 components include a cylinder body 160, a discharge cover 165, valves 170, 172, suction bores 175, 177, springs 180, 182, a valve stop 185, packing 190, a fluid cylinder 195, a cover 197, and an intake 199. The packing 190 and the cylinder body 160 are configured to receive the plunger 115 from the power end assembly 105 side of the hydraulic fracturing pump 100. Insertion and removal of plunger 115 creates the positive and negative pressure loads within the fluid end assembly 110 components that draw low-pressure fracking fluid from a reservoir and then turn it into high-pressure fracking fluid that is purged through the discharge cover 165 to be received by a well bore. For example, the upstroke of plunger 115 puts pressure on spring 180, which opens valve 170 and permits low-pressure fracking fluid to be drawn through intake 199. Fracking fluid travels through intake 199, then through suction bore 175 and into the main body of the fluid end assembly 110. Cover 197 serves as a stopping point for the plunger 115. Valve stop 185 provides for a stopping point enforcer for the maximum open position of the valve 170, which includes a valve body and valve seat. The down stroke of plunger 115 closes valve 170 and opens valve 172 and also pressurizes the low-pressure fracking fluid to form the high-pressure fracking fluid. The high-pressure fracking fluid may travel through open valve 172, fluid cylinder 19, and discharge cover 165 to be sent down a wellbore to create cracks in the deep-rock formations to stimulate flow of natural gas, petroleum, and brine.

Figure 2:
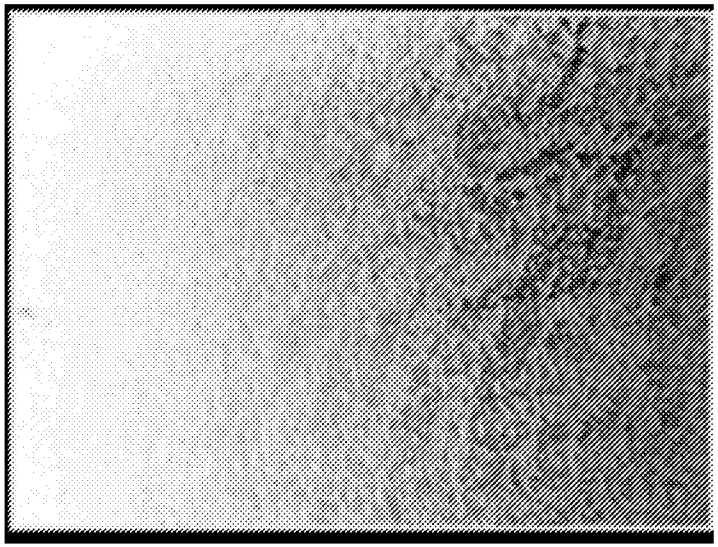
FIG. 2 illustrates pitting on a metal component of a hydraulic fracturing pump caused by exposure to high-pressure fluid containing abrasive and corrosive components.

In general, as the fluid end assembly of a hydraulic fracturing pump as shown in FIG. 1 is exposed to high-pressure fluids and sand, the components begin to degrade, leading to pitting. FIG. 2 illustrates pitting on a hydraulic fracking pump component as the result of exposure to abrasive and corrosive components of fracking fluid end assembly. Pitting of pump components leads to irregularities in pressure and leads to concentrated areas of stress. For example, as the pits get larger, high-pressure fluids collect in the pit, thereby creating specific pressure points, or concentrated areas of stress, that lead to increased degradation as that pit site. Additionally, as the pits and concentrated areas of stress accumulate, overall system pressures can be affected, leading to performance degradation. The accumulation of backpressure or simple wear causes the seals and metal components of the pump to degrade, leading to fluid leakage and pump failure. Additionally, a common failure of hydraulic fracking pump components due to exposure to fracking fluid is fatigue cracking, wherein a component exhibits failure due to excess pressure loading. Fatigue cracking may initiate at the surface of the component or at internal sites. It may be initiated through surface flaws such as the above-described pitting. Also, a common site for cracking is at the intersecting bore within the fluid end assembly. Other components such as valve seats commonly crack inside the valves of the fluid end assembly.

Figure 3:
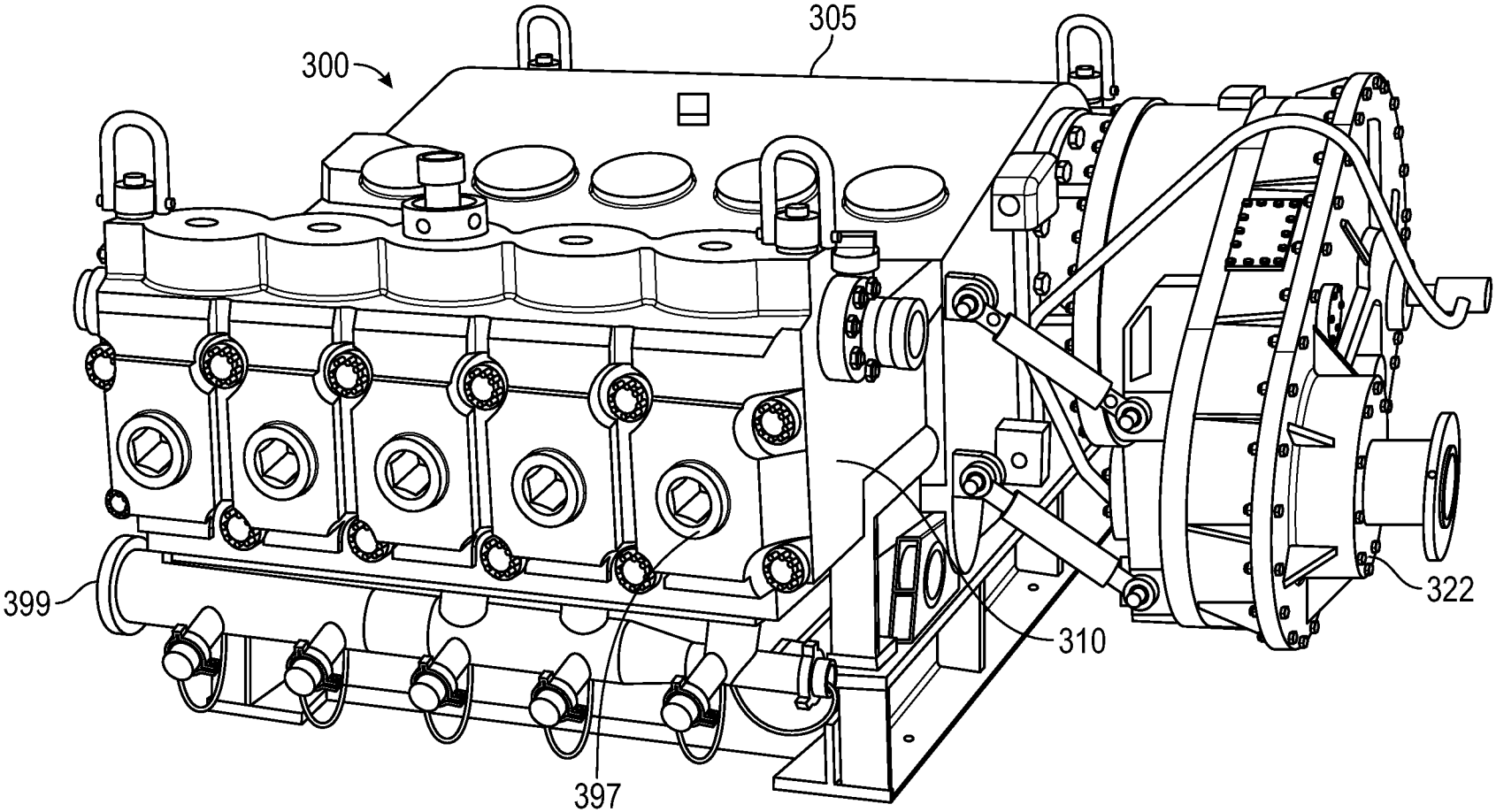
FIG. 3 illustrates a front perspective of a hydraulic fracturing pump, according to a specific example embodiment of the disclosure.

FIG. 3 illustrates a front perspective of a hydraulic fracturing pump 300, according to a specific example embodiment of the disclosure, wherein the hydraulic fracturing pump 300 includes components comprising a resistant steel composition as described herein. Any component of the hydraulic fractuing pump 300 may be made from a resistant steel composition including, but not limited to, a crank case 322, a fluid end assembly 310, a power end assembly 305, a cover 397, and an intake 399.

Figure 4A:
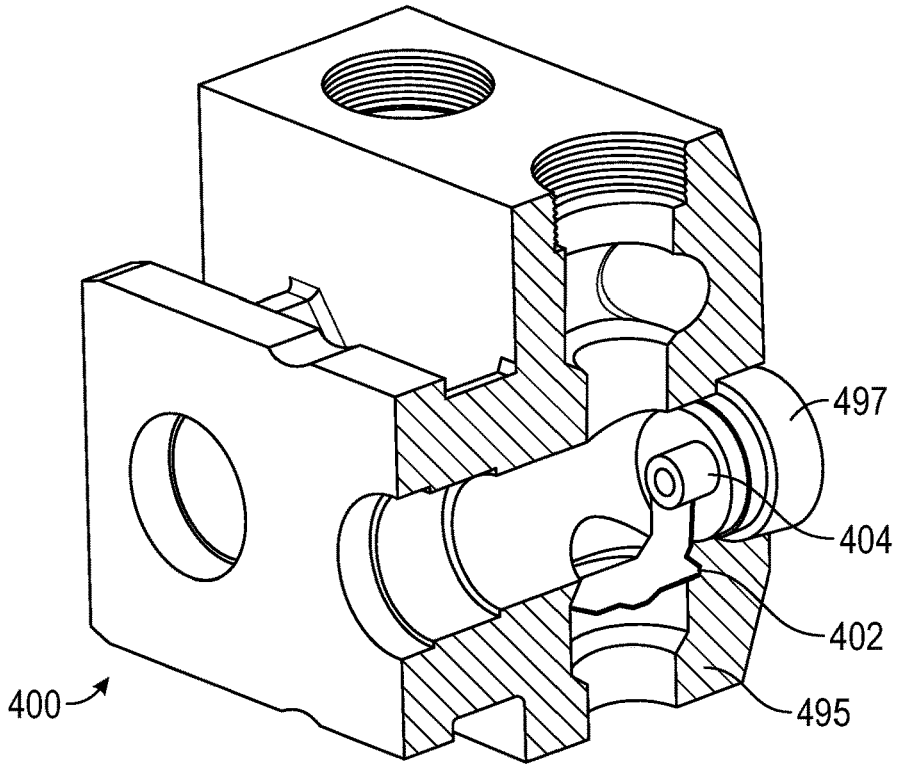
FIG. 4A illustrates a front perspective of a grooveless fluid end assembly having a valve stop design that locks under a ridge in the fluid cylinder bore, according to a specific example embodiment of the disclosure.
Figure 4B:
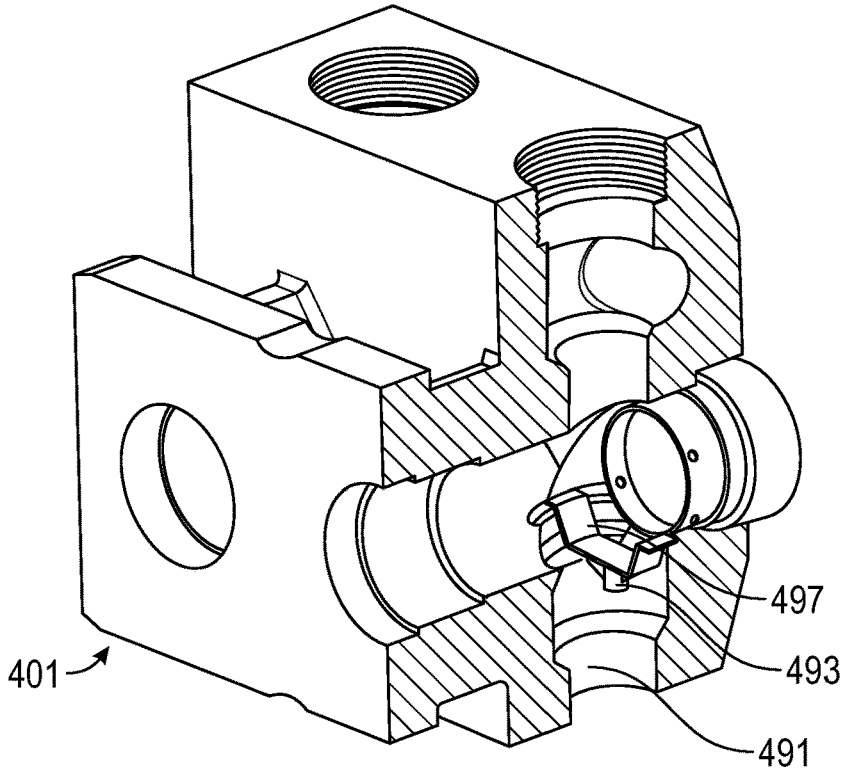
FIG. 4B illustrates a front perspective of a fluid end assembly having a grooved suction bore to lock the valve stop in place, according to a specific example embodiment of the disclosure.

As shown in FIG. 3, hydraulic fracturing pumps 300 include fluid end assemblies 310. Fluid end assemblies can be designed to have various configurations. For example, FIGS. 4A and 4B illustrate perspectives of different fluid end assembly designs according to specific example embodiments of the disclosure. As shown in FIG. 4A, a fluid end assembly 400 may be grooveless and have a valve stop 402 design that locks under a ridge in the fluid cylinder bore 495 and is held in place by a stem 404 in the suction cover 497. The grooveless design may desirably reduce the occurrence of washout or erosion leaking to valve leakage through. The grooveless design may prevent stress cracks that tend to begin formation in grooves. Grooveless designs may permit increased pumping durations, pressures, and flow rates. Additionally, in some embodiments, a fluid end assembly may have a grooved suction bores. As shown in FIG. 4B, a fluid end assembly 401 may include a grooved suction bore 491 that utilizes a wing style vale stop 493 that is locked in place through the grooves 497 that are machined into the suction bore 491. Any component of the fluid end assemblies shown in FIG. 4A and FIG. 4B can be made of a resistant steel composition.

A hydraulic fracking pump component (e.g., a fluid end assembly) composed of a resistant steel composition, hereinafter referenced as a resistant pump component, may have enhanced wear resistance, corrosion resistance, or a combination thereof when compared to a comparable hydraulic fracking pump component composed of carbon alloy steel, hereinafter referenced as a carbon alloy pump component. In some embodiments, a resistant pump component (e.g., a fluid end assembly) may have an extended life span when compared to a carbon alloy pump component. For example, a resistant pump component when compared to a carbon alloy pump component exposed to the same conditions may have an average lifespan that is at least 10% longer, at least 25% longer, or at least 50% longer, or at least 100% longer, or at least 125% longer, or at least 150% longer, or at least 200% longer, or at least 250% longer, or at least 300% longer, or at least 350% longer, or at least 400% longer, or at least 450% longer, or at least 500% longer than that of its carbon alloy counterpart.

A resistant pump component may exhibit less pitting (indicative of corrosion) compared to a carbon alloy pump component exposed to the same conditions. For example, a resistant pump component may exhibit at least 5%, or at least 10%, or at least 15%, or at least 20%, or at least 25%, or at least 30%, or at least 35%, or at least 40%, or at least 45%, or at least 50% less pitting compared to its carbon alloy steel counterpart.

A resistant pump component may exhibit an average lifespan, less pitting, or a combination thereof compared to a carbon alloy pump component.

A resistant pump component may have a manufacturing cost that is less than a counterpart pump component composed of stainless steel, hereinafter referenced as a stainless pump component. For example, a resistant pump component may have a manufacturing cost that is at least 5% less, or at least 10% less, or at least 15% less, or at least 20% less, or at least 30% less, or at least 40% less, or at least 50% less, or at least 60% less than a stainless pump component having comparable life span and/or resistance characteristics. In some embodiments, a resistant pump component may have a manufacturing cost that is at least at least 5% less, or at least 10% less, or at least 15% less, or at least 20% less, or at least 30% less, or at least 40% less, or at least 50% less, or at least 60% less than a stainless pump component when factored as a cost per average working hour. For example, if a stainless pump component has a lifespan of 2000 working hours at a cost of $3 USD per pound. The cost of the stainless pump component is $0.0015 per working hour.

As will be understood by those skilled in the art who have the benefit of the instant disclosure, other equivalent or alternative compositions, devices, and disclosed steel component containing hydraulic fracturing pump systems with a barrier element sand separator can be envisioned without departing from the description contained in this application. Accordingly, the manner of carrying out the disclosure as shown and described is to be construed as illustrative only.

Persons skilled in the art can make various changes in the shape, size, number, and/or arrangement of parts without departing from the scope of the instant disclosure. For example, the position and number of connecting rods can be varied. In some embodiments, plungers can be interchangeable. In addition, the size of a device and/or system can be scaled up or down to suit the needs and/or desires of a practitioner. Each disclosed process, system, method, and method step can be performed in association with any other disclosed method or method step and in any order according to some embodiments. Where the verb "may" appears, it is intended to convey an optional and/or permissive condition, but its use is not intended to suggest any lack of operability unless otherwise indicated. Where open terms such as "having" or "comprising" are used, one of ordinary skill in the art having the benefit of the instant disclosure will appreciate that the disclosed features or steps optionally can be combined with additional features or steps. Such option may not be exercised and, indeed, in some embodiments, disclosed systems, compositions, apparatuses, and/or methods can exclude any other features or steps beyond those disclosed in this application. Elements, compositions, devices, systems, methods, and method steps not recited can be included or excluded as desired or required. Persons skilled in the art can make various changes in methods of preparing and using a composition, device, and/or system of the disclosure.

Also, where ranges have been provided, the disclosed endpoints can be treated as exact and/or approximations as desired or demanded by the particular embodiment. Where the endpoints are approximate, the degree of flexibility can vary in proportion to the order of magnitude of the range. For example, on one hand, a range endpoint of about 50 in the context of a range of about 5 to about 50 can include 50.5, but not 52.5 or 55 and, on the other hand, a range endpoint of about 50 in the context of a range of about 0.5 to about 50 can include 55, but not 60 or 75. In addition, it can be desirable, in some embodiments, to mix and match range endpoints. Also, in some embodiments, each figure disclosed (e.g., in one or more of the examples, tables, and/or drawings) can form the basis of a range (e.g., depicted value +/− about 10%, depicted value +/− about 50%, depicted value +/− about 100%) and/or a range endpoint. With respect to the former, a value of 50 depicted in an example, table, and/or drawing can form the basis of a range of, for example, about 45 to about 55, about 25 to about 100, and/or about 0 to about 100. Disclosed percentages are volume percentages except where indicated otherwise.

All or a portion of a disclosed steel hydraulic fracturing pump can be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

What is claimed is:

1. A resistant steel composition comprising
- a nickel content from about 3% MB to about 4% MB;
- a manganese content from about 0.5% MB to about 1.5% MB;
- a chromium content from about 12% MB to about 13.4% MB;
- a molybdenum content from about 0.3% MB to about 0.7% MB; and
- a copper content of less than about 0.40% MB, wherein the resistant steel further comprises at least one of:
- a J-Factor value of less than about 300;
- a minimum yield strength ranging from 130 Ksi to 150 Ksi;
- a YTS ranging from 140 Ksi to 160 Ksi;
- a longitudinal minimum Charpy @−22° F. ranging from 70 ft./lbs. to 90 ft./lbs.;
- a transverse minimum Charpy @−22° F. ranging from 60 ft./lbs. to 80 ft./lbs.;
- an elongation value of 16/14 (L/T);
- an Ra value of 55/50 (L/T); and
- a Brinell Hardness Number ranging from 315 to 375.

2. The resistant steel composition according to claim 1, further comprising:

a carbon content of less than about 0.05% MB;

a nitrogen content of less than about 0.10% MB; and an aluminum content of less than about 0.025% MB.

3. The resistant steel composition according to claim 1, further comprising at least one of:

a combined carbon and nitrogen content ranging from about 0.03% MB to about 0.1% MB;

a combined titanium, niobium, and vanadium content ranging from about 0.01% MB to about 0.15% MB; and a combined molybdenum and tungsten content ranging from about 0.32% MB to about 0.70% MB.

4. The resistant steel composition according to claim 1, wherein the resistant steel further comprises the J-Factor value of less than about 300.

5. The resistant steel composition according to claim 1, wherein the resistant steel further comprises the minimum yield strength ranging from 130 Ksi to 150Ksi.

6. The resistant steel composition according to claim 1, wherein the resistant steel further comprises the YTS ranging from 140 Ksi to 160 Ksi.

7. The resistant steel composition according to claim 1, wherein the resistant steel further comprises the longitudinal minimum Charpy @−22° F. ranging from 70 ft./lbs. to 90 ft./lbs.

8. The resistant steel composition according to claim 1, wherein the resistant steel further comprises the transverse minimum Charpy @−22° F. ranging from 60 ft./lbs. to 80 ft./lbs.

9. The resistant steel composition according to claim 1, wherein the resistant steel further comprises the elongation value of 16/14 (L/T).

10. The resistant steel composition according to claim 1, wherein the resistant steel further comprises the Ra value of 55/50 (L/T).

11. The resistant steel composition according to claim 1, wherein the resistant steel further comprises the Brinell Hardness Number ranging from 315 to 375.

12. A hydraulic fracturing pump comprising a fluid end assembly, the fluid end assembly comprising:

a cylinder body configured to receive a respective plunger from a power end assembly;

a suction bore configured to house a valve body, a valve seat, and a spring; and a spring retainer, wherein at least one of the cylinder body, the suction bore, and the spring retainer comprises a steel composition comprising:

a nickel content from about 3% MB to about 4% MB;

a manganese content from about 0.5% MB to about 1.5% MB;

a chromium content from about 12% MB to about 13.4% MB;

a molybdenum content from about 0.3% MB to about 0.7% MB; and a copper content of less than about 0.40% MB, wherein the steel composition further comprises at least one of:

a J-Factor value of less than about 300;

a minimum yield strength ranging from 130 Ksi to 150 Ksi;

a YTS ranging from 140 Ksi to 160 Ksi;

a longitudinal minimum Charpy @−22° F. ranging from 70 ft./lbs. to 90 ft./lbs.;

a transverse minimum Charpy @−22° F. ranging from 60 ft./lbs. to 80 ft./lbs.;

an elongation value of 16/14 (L/T);

an Ra value of 55/50 (L/T); and a Brinell Hardness Number ranging from 315 to 375.

13. The hydraulic fracturing pump according to claim 12, wherein the steel composition further comprises at least one of:

a carbon content of less than about 0.05% MB;

a nitrogen content of less than about 0.10% MB; and an aluminum content of less than about 0.025% MB.

14. The hydraulic fracturing pump according to claim 12, wherein the steel composition further comprises at least one of:

a combined carbon and nitrogen content ranging from about 0.03% MB to about 0.1% MB;

a combined titanium, niobium, and vanadium content ranging from about 0.01% MB to about 0.15% MB; and a combined molybdenum and tungsten content ranging from about 0.32% MB to about 0.70% MB.

15. The hydraulic fracturing pump according to claim 12, wherein the steel composition further comprises the J-Factor value of less than about 300.

16. The hydraulic fracturing pump according to claim 12, wherein the steel composition further comprises the minimum yield strength ranging from 130 Ksi to 150 Ksi.

17. The hydraulic fracturing pump according to claim 12, wherein the steel composition further comprises the YTS ranging from 140 Ksi to 160 Ksi.

18. The hydraulic fracturing pump according to claim 12, wherein the steel composition further comprises the longitudinal minimum Charpy @−22° F. ranging from 70 ft./lbs. to 90 ft./lbs.

19. The hydraulic fracturing pump according to claim 12, wherein the steel composition further comprises the transverse minimum Charpy @−22° F. ranging from 60 ft./lbs. to 80 ft./lbs.

20. The hydraulic fracturing pump according to claim 12, wherein the steel composition further comprises the elongation value of 16/14 (L/T).

21. The hydraulic fracturing pump according to claim 12, wherein the steel composition further comprises the Ra value of 55/50 (L/T).

22. The hydraulic fracturing pump according to claim 12, wherein the steel composition further comprises the Brinell Hardness Number ranging from 315 to 375.

* * * * *